US005833095A

United States Patent [19]

Russell et al.

[11] Patent Number: 5,833,095

[45] Date of Patent: Nov. 10, 1998

[54] TOOL AND FASTENER HOLDER WITH DETACHABLE HOLDING BELT

[75] Inventors: Edmund O. Russell, Northhampton; Michael Paulsen, Haydenville, both of Mass.

[73] Assignee: Task Corporation, Northampton, Mass.

[21] Appl. No.: 986,066

[22] Filed: Dec. 5, 1997

[51] Int. Cl.[6] ..... A45F 5/00

[52] U.S. Cl. ..... 224/576; 224/584; 224/665; 224/680; 224/681; 224/683; 224/684; 224/904; 206/373; 220/735

[58] Field of Search ..... 224/904, 575, 224/576, 578–583, 584, 660, 663, 665, 668, 676, 680, 681, 682, 683, 255, 684; 206/372, 373; 220/735

[56] References Cited

U.S. PATENT DOCUMENTS 4,993,551 2/1991 Lindsay ..... 206/373
5,174,447 12/1992 Fleming ..... 206/373
5,429,265 7/1995 Maire et al. ..... 206/372
5,501,379 3/1996 Munoz ..... 224/665
5,683,022 11/1997 Evans ..... 224/583

*Primary Examiner*—Allan N. Shoap
*Assistant Examiner*—Gregory M. Vidovich
*Attorney, Agent, or Firm*—John J. Welch, Jr., Esq.

[57] ABSTRACT

A tool and fastener holder with detachable holding belt to both of which a plurality of male couplers are affixed and able to line a bucket both inside and out and both holder and belt each being amenable to receipt of a plurality of detachable pouches containing various species of fasteners, one species per pouch with the belt able to via a plurality of tool holding components detachably hold various hammers, crowbars, screwdrivers and the like.

18 Claims, 6 Drawing Sheets

TOOL AND FASTENER HOLDER WITH DETACHABLE HOLDING BELT

FEDERALLY SPONSORED RESEARCH AND DEVELOPMENT

Figure 1:
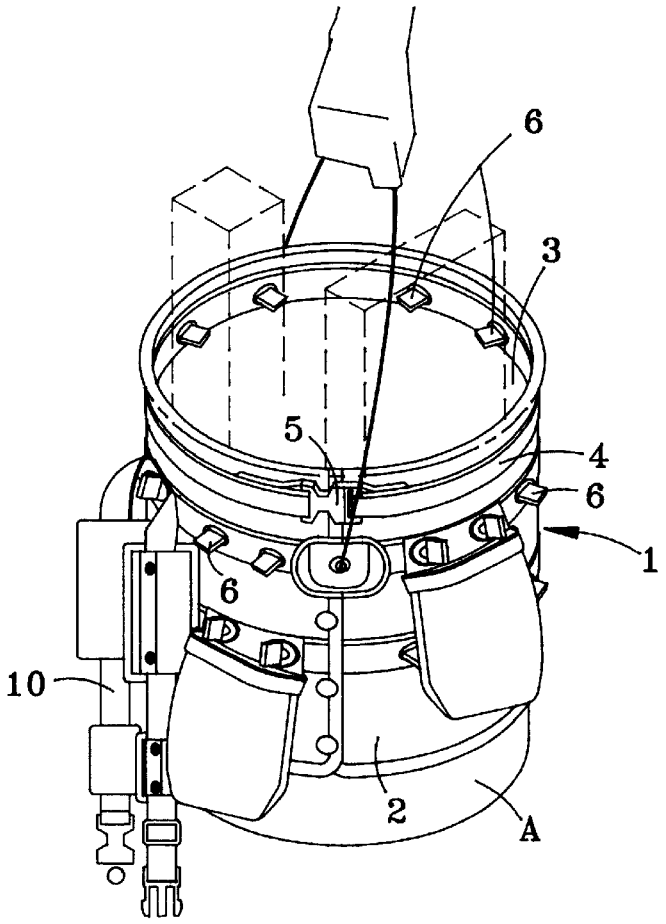

The instant invention is in no way involved with any federally sponsored research and development.

CROSS REFERENCES TO PRIOR APPLICATIONS

There are no cross references to any prior applications, of which there are none.

BACKGROUND OF THE INVENTION

1. Field of the Invention

The instant invention relates to those particular types of devices that serve to hold tools and fasteners utilized within the building and construction trades.

2. Prior Art

The following references are from within the field of the instant invention but do not anticipate the instant invention:

| Inventor | Patent | Patent No. | Date |
|---|---|---|---|
| Noriega, et al. | Detachable Article Holders | 5,505,356 | 4/9/96 |
| Schue | Utility Belt with Back Support | 5,201,448 | 4/13/93 |
| Munoz | Modular Utility Belt | 5,501,379 | 3/26/96 |
| Dozier | Mechanical Outfit for Lathers and Carpenters | 1,292,728 | 1/28/19 |
| Ashley | Pouch Assembly for Carpenters and Other Tradesmen | 4,932,576 | 6/12/90 |
| Trumpower, II | Utility Belt | 4,747,527 | 5/31/88 |
| Jennings | Pocketed Carrier | 1,282,695 | 10/22/18 |
| M. C. Smith | Lady's Purse | 2,317,820 | 4/27/43 |
| Spillers et al. | Hose Handler | 4,762,257 | 8/9/88 |
| Cawile, Jr. | Modular Pack System | 5,445,303 | 8/29/95 |
| Hogan | Fireman's Belt | 1,010,768 | 12/5/11 |
| J. E. Dietzgen | Clip | 2,543,313 | 2/27/51 |
| Keer | Work Belts with Lumbar Supports Stretchable Side Panels and Interchangeable Pouches | 5,349,706 | 9/27/94 |

SUMMARY OF THE INVENTION

1. A Brief Description of the Invention

The invention is made up of a sturdy heavy cloth or canvas or leather liner material amenable to completely circumferentially lining a conventional cylindrically shaped tool bucket. Affixed to the liner material are a plurality of male coupler units with swivelable head components amenable to being turned through an angle of 90°. Detachably affixable to each of a pair of such coupler units, there being numerous pairing options as respects said plurality of coupler units, are various pouches likewise made up of a sturdy, heavy cloth or canvas or leather material. The pouches are united with such coupler units in pairs by way of metallically lined upper corner holes located near the ends of the backside top edges of such pouches. Once united with coupler units through the metallically lined upper corner holes, the heads of the male coupler units are turned through an angle of 90° to thereby hold the pouches fast to the liner. The pouches are both large and small. Certain of the large pouches have affixed to the front sides thereof, a pair of such male coupler units as well. In this way, smaller pouches likewise equipped with backside top edge metallically lined upper corner holes can be detachably affixed to larger pouches in the same way that larger pouches are attached to the liner material. The pouches themselves serve to carry fasteners such as nails, screws, bolts, clips, etc. One pouch holds only nails of one size, another holds nails of a different size. Yet another pouch holds screws, still another holds clips, etc. Also, detachably affixed to the liner by way of perhaps hook and fastener tape or indeed even by way of a sole male coupler unit of the order of the ones described above and a metallically lined hole therein is a detachable holding belt component. The detachable holding belt component also made up of materials as noted above adjustably buckles about the waist of a tradesperson. Affixed to the belt is a series of male coupler units of the order of the ones described above. Various of the smaller pouches, or larger pouches holding smaller pouches described above as being held by the liner material can be detached therefrom and then detachably affixed to the belt. The belt is also equipped to receive and hold in a manner similar to the holding of the pouches, hardback hammer and screwdriver holders as well.

2. Objects of the Invention

Organization of one's tools, nails, screws, bolts, hammers, clips, etc., at a job site is often a difficult task at best. Far too often, a tradesperson loses valuable time when forced to sort through trays and/or pockets full of nails, screws, clips and the like to find what he or she is looking for at the instant he or she needs it. Moreover, as is often the case, from time to time on a given job at a particular site, not all of what the tradesperson has in his or her array of tools and fasteners is instantly needed. The present invention with its multiplicity of detachable pouches enables a tradesperson to carry, to and from a job site, all of his or her pre-organized portable tools and fasteners without the need for continuous sorting or searching for what is momentarily needed and without the need to broach every single work location at a particular job site always with all of his or her both needed and unneeded tools and fastener units. The instant invention responds magnificently to a tradesperson's need to stay continuously organized as respects all of his or her tools and fasteners while likewise being required only to move from one work location to another on a job site with only such of his/her tools and fasteners already organized as would be essential at the latest work location. No present day or previously manufactured tool and/or fastener organizer units have ever been able to serve the dual function of organized portability of all of one's tool and fastener devices coupled with ready availability away from the bucket liner source of such organized portability of only those fasteners and tools as would be essential at a given work location at a particular job site. Tool and/or fastener organizer units other than the instant invention either have pockets permanently affixed to liner material or have no pockets at all but rather have rigid circular divided trays attached to the liner and only within, not without a holding bucket. Still others are characterized by the presence of sacks for holding fasteners with tie strings about the top sides of the sacks within the bucket. Tradespersons utilizing such devices need to forever unload and reload pockets on a belt and fill or empty pockets or sacks on a liner in a time and effort consuming endeavor to be ready to perform reasonably optimally at a next upcoming work location. All of such time and effort difficulties are completely obviated by virtue of resort to utilization of the instant invention for purposes of holding one's fastener units and tools.

For the reasons cited above, respectfully submitted, the instant invention is indeed new, useful and unquestionably unique.

A DESCRIPTION OF THE DRAWINGS

1. FIG. 1 depicts a tool bucket circumscribed by the liner component of the instant invention likewise illustrating the belt component of the instant invention as affixed thereto.

Figure 2:
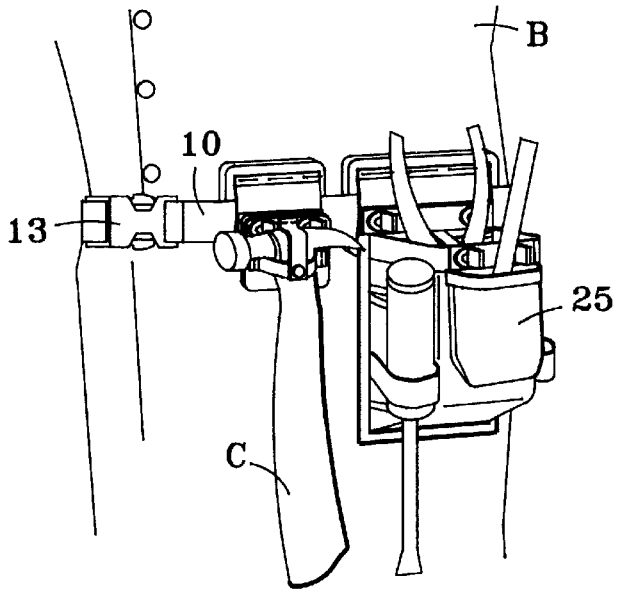

2. FIG. 2 depicts the belt component of the instant invention being worn by a tradesperson.

Figure 3:
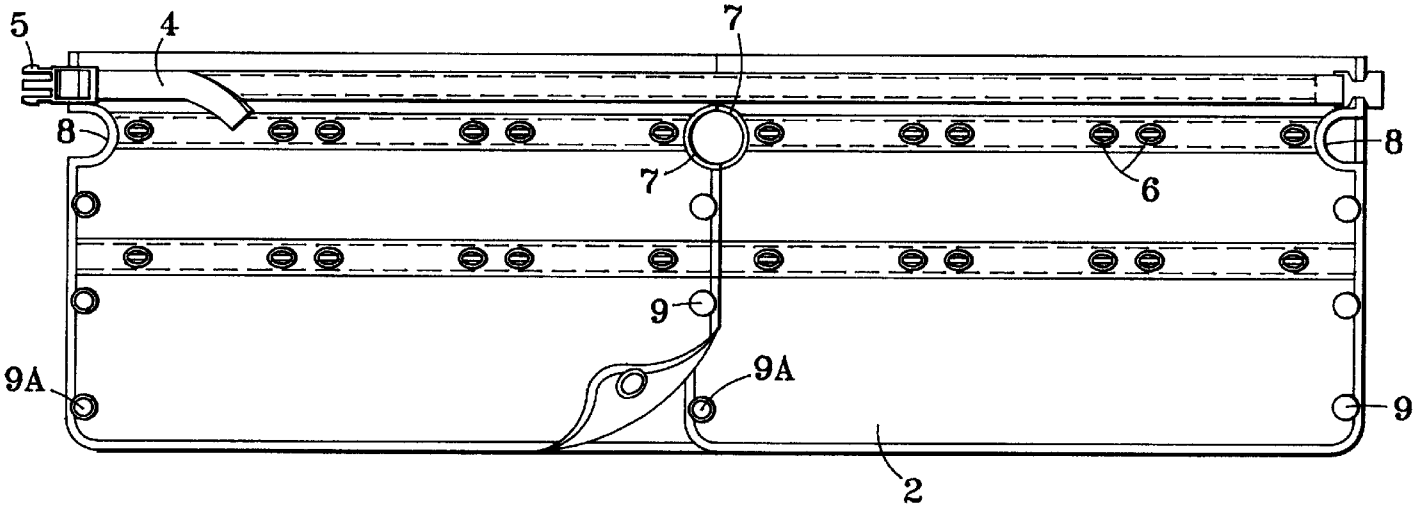

3. FIG. 3 is a plan view of the frontal aspect of the lower half of the liner component of the instant invention.

Figure 4:
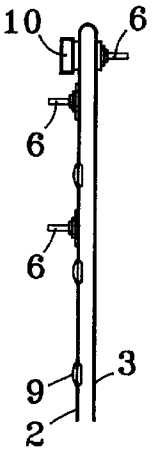

4. FIG. 4 is an end view of the lower half of the liner component of the instant invention.

Figure 5:
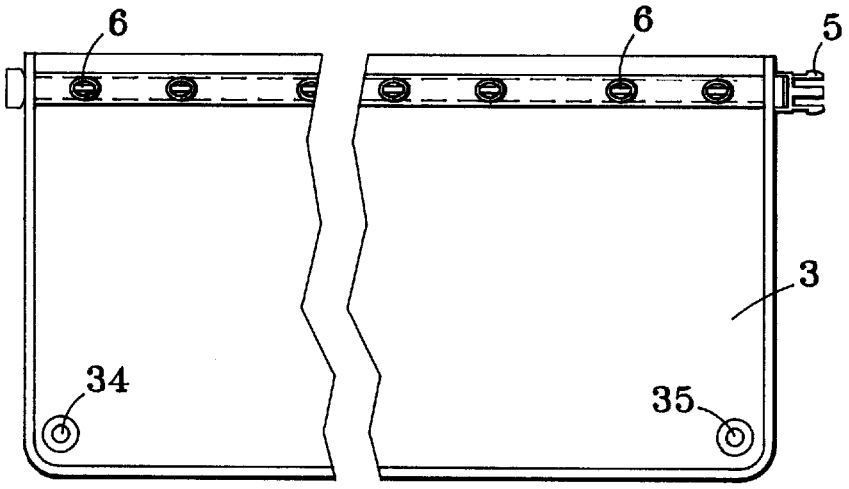

5. FIG. 5 is a plan view of the frontal aspect of the upper half of the liner component of the instant invention.

Figure 6:
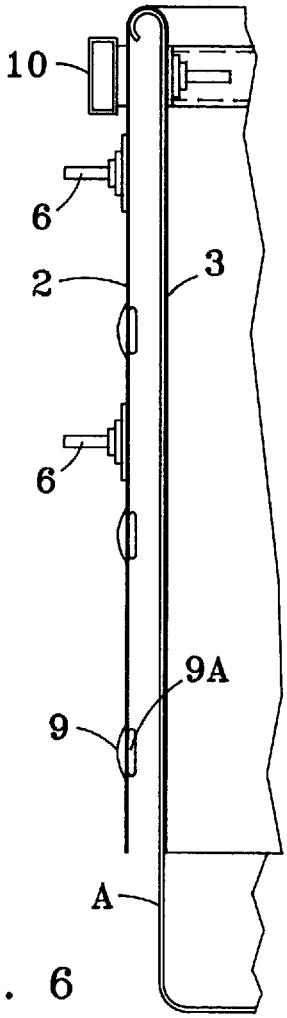

6. FIG. 6 is a broken end view depicting the liner component of the instant invention as it lines a tool bucket both inside and out.

Figure 7:
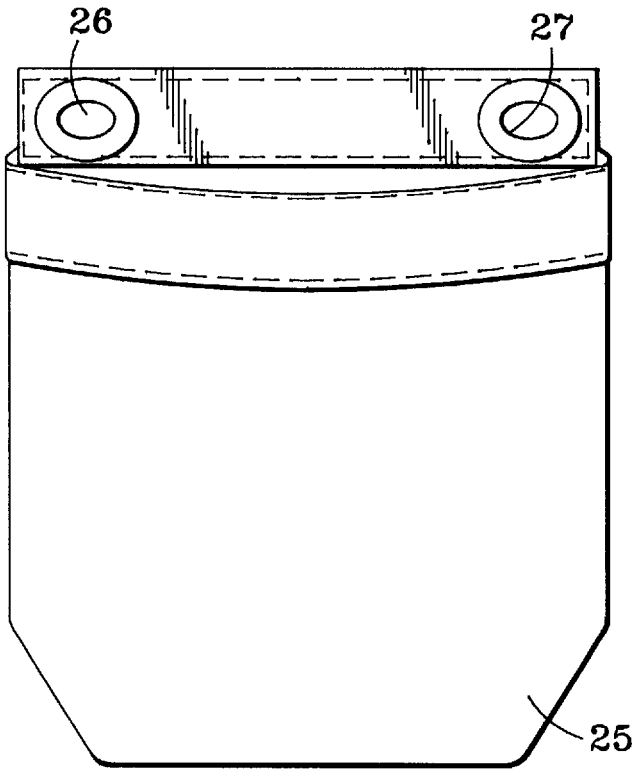

7. FIG. 7 is a frontal plan view of one of the small pouch components of the instant invention.

Figure 8:
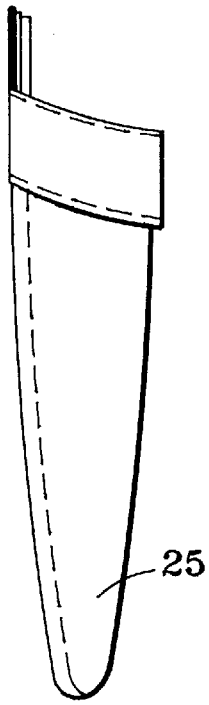

8. FIG. 8 is a lateral plan view of the small pouch component seen in FIG. 7.

Figure 9:
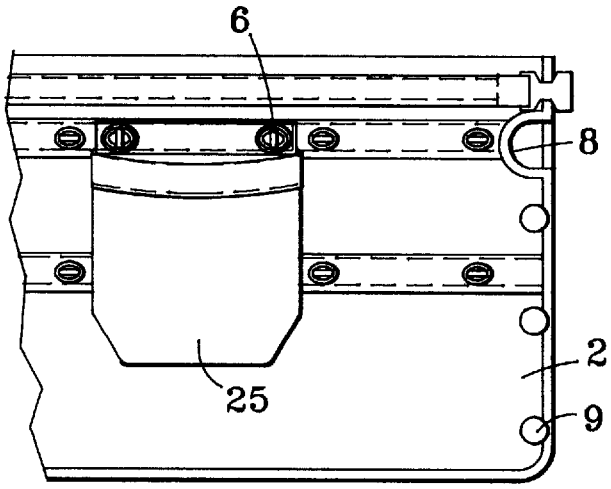

9. FIG. 9 depicts a small pouch component of the instant invention detachably affixed to the liner component thereof.

Figure 10:
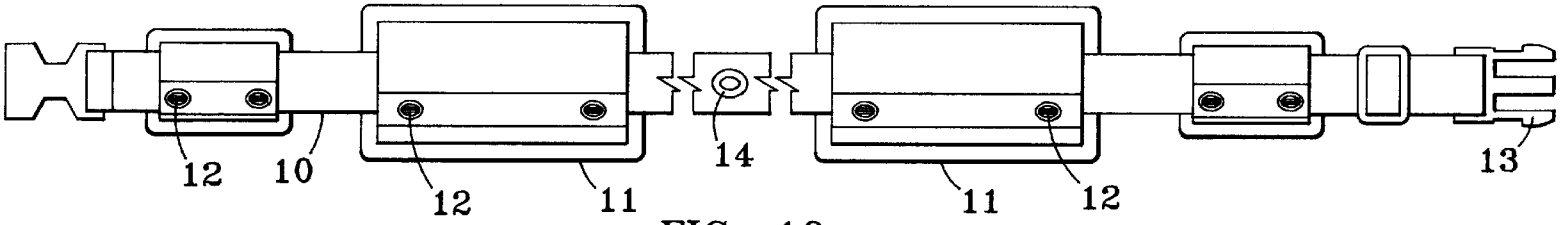

10. FIG. 10 is a broken plan view of the belt component of the instant invention.

Figure 11:
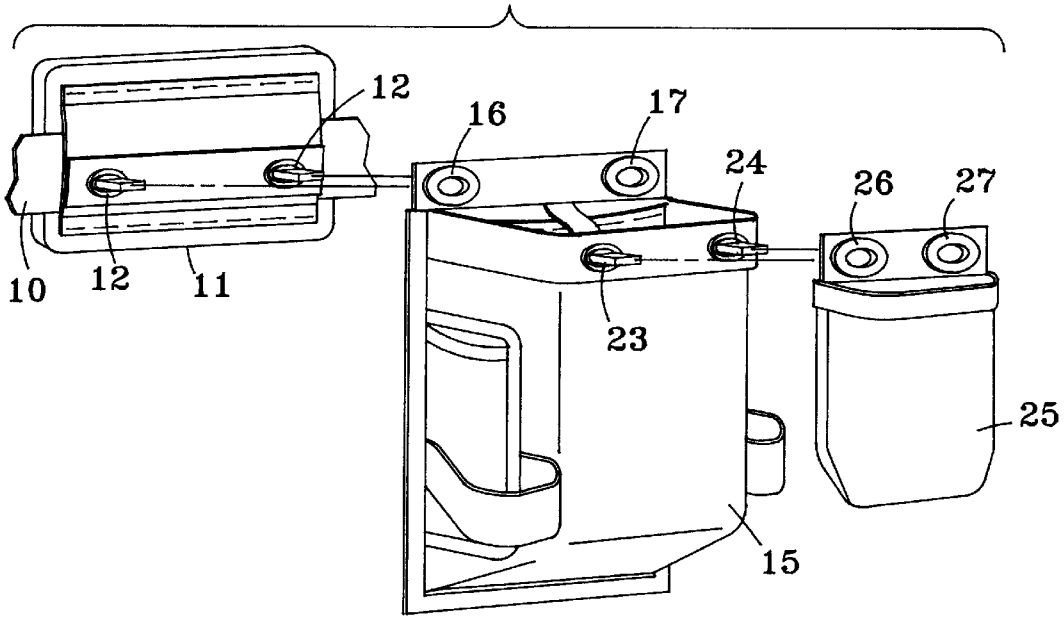

11. FIG. 11 serves to illustrate in exploded perspective view how a small pouch component of the instant invention is detachably affixable to a large pouch component thereof which is in turn detachably affixable to the belt or liner component thereof.

Figure 12:
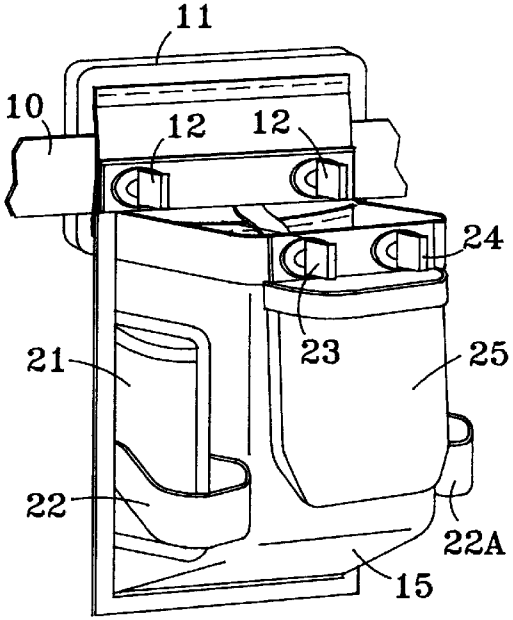

12. FIG. 12 shows in perspective view, a small pouch component held by a large pouch component in turn held by the belt component of the instant invention.

Figure 13:
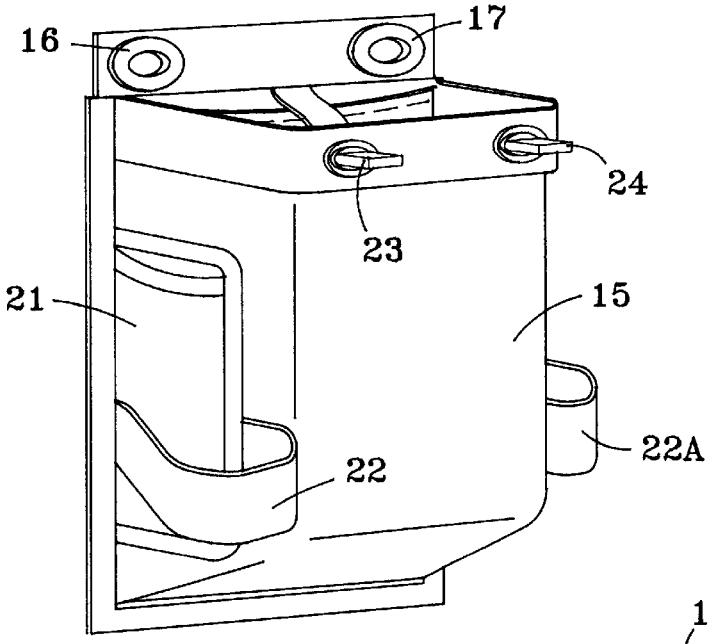

13. FIG. 13 is an isolated perspective view of a large pouch component of the instant invention.

Figure 14:
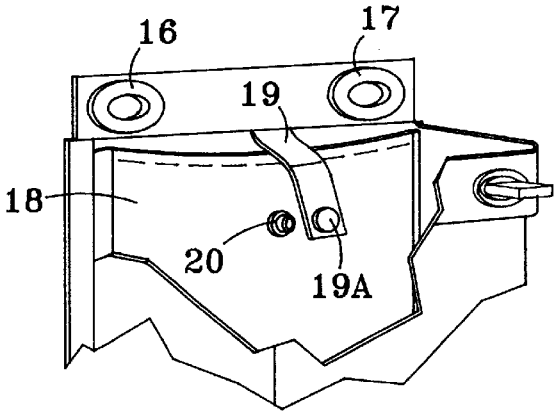

14. FIG. 14 is a broken view serving to show a pocket snap fastenably closeable within the large pouch seen in FIG. 13.

Figure 15:
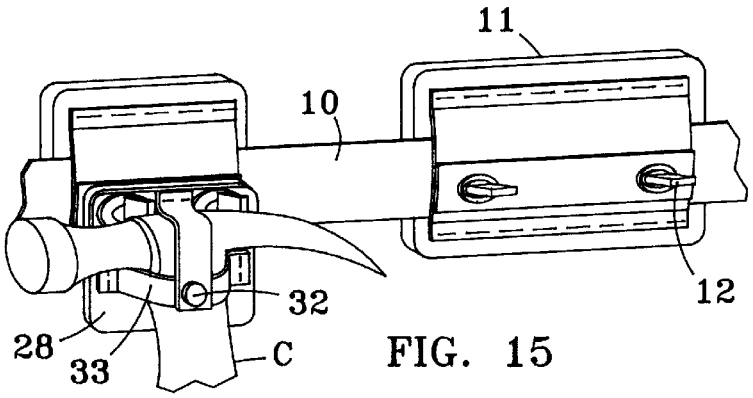

15. FIG. 15 is an isolated perspective view of a tool holding component of the instant invention.

Figure 16:
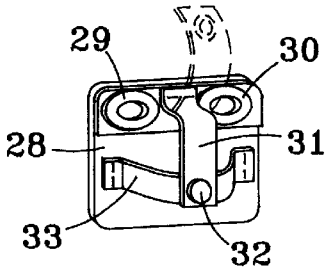

16. FIG. 16 depicts the manner in which the tool holding component shown in FIG. 15 is held to the belt component of the instant invention.

A DESCRIPTION OF THE PREFERRED EMBODIMENTS

FIG. 1 discloses a tradesperson's tool and fastener bucket A lined both inside and out with the liner component 1 of the instant invention. A lower portion 2 thereof lines the exterior of the bucket and an upper portion 3 thereof lines the interior of the bucket. A liner belt 4 circumscribes bucket A and is situated near the bottom of upper portion 3 and near the top of lower portion 2. Buckle means 5 serve to facilitate tightening of belt 4 about bucket A as lined by liner component 1. Additionally, liner component 1 can be hung on a wall or from scaffolding in such a way as to readily make items detachably affixed thereto readily available. Within the interior of bucket A near the base of upper portion 3 are to be found affixed to liner component 1, a plurality of male coupler units 6 all in a row affixed, near the bottom of upper portion 3 to liner component 1. All coupler units 6 have stiffly swivelable heads. Affixed to liner component 1 is belt component 10. Component 10 is detachable from component 1 and is held in place by way of a metallically lined belt through hole 14 in component 10 through which one of a plurality of male coupler units 6 found on bottom of the upper portion 3 is inserted with a stiffly swivelable head thereupon turned through an angle of 90°. Belt through hole 14 is more readily shown in FIG. 10. A broken plan view of upper portion 3 is seen in FIG. 5. Seen in FIG. 5 are hanging through holes 34 and 35 aligned metallically or with hard plastic or rubberlike material serving to maintain the continuing integrity thereof and facilitating the hanging of liner component 1 with items detachable affixed thereto from scaffolding or on a wall. A plan view of lower portion 2 is seen in FIG. 3. In FIG. 3 first handle hole arcs 7, the perimeters of which are metallically lined come together to form a hole through which one end of a handle of bucket A can pass once bucket A is lined with liner component 1. Second handle hole arcs 8, the perimeters of which are also metallically lined come together when liner component 1 is wrapped about bucket A to form a second hole through which the other end of the handle of bucket A can pass. The conjunction of arcs 7 and 8 is actuated by virtue of the presence of a plurality of male and female snap fastener means 9 and 9A columnly aligned with arcs 7 and 8 as shown in FIG. 3 and attached at opposing ends of lower portion 2 which is severable into halves just below the alignment of liner belt 4 as it is attached on liner component 1 in order to facilitate ready placement on and removal from bucket A of liner component 1. FIG. 4 is an end view of liner component 1 in an isolated setting. Liner component 1, belt 5, and belt 10 are made up of heavy duty, sturdy woven cloth or canvas or leather material. The material aligning the perimeters of belt hole 14 and hole arcs 7 and 8 is typically metallic and is respectively affixed in respect of circumscribing same, to belt component 10 and liner component 1. This material serving to maintain the continuing integrity of hole 14 and arcs 7 and 8 could also be heavy plastic or a rubberlike material as well. In lieu of snap fastener means 9 and 9A, hook and fastener tape means for conjoining the halves and ends of lower portion 2 could be resorted to as well. FIG. 6 is an end view of upper portion 3 and lower portion 2 of liner component 1 circumscribing and lining the siding of bucket A. FIG. 2 illustrates how belt component 10 is worn by a tradesperson B after it is removed from liner component 1 by way of a turning through an angle of 90° the stiffly swivelable head of a coupler unit 6 otherwise holding it thereto through belt hole 14. Buckle means 13 enables belt component 10 to be fastened about the waist of tradesperson B. Belt component 10 is characterized by a plurality of paired male coupler holder units 11 all having affixed thereto a pair of male belt coupler units 12 with stiffly swivelable heads. Coupler units 12 are identical to coupler units 6. Holder units 11 are threaded to belt component 10 by way of apertures in the lateral aspects thereof. Holder units 11 consist of hardbacked leather or perhaps wood or indeed even only heavy woven cloth material to which a woven cloth material is frontally affixed at a top edge and at a bottom edge only. Affixed to such frontally affixed material are the paired coupler units 12 per single holder unit 11. FIG. 7 is a frontal view of one of a plurality of identical small pouch components 25 of the instant invention shown in lateral view in FIG. 8. Small pouch components 25 are typically made up of a heavy, sturdy woven cloth or canvas or leather material. A first small pouch metallically lined through hole 26 and a second small pouch metallically lined through hole 27 are seen respectively in a first upper top posterior side corner and in a second upper top posterior side corner thereof. A metallic or hard plastic or rubberlike material is affixed about the perimeters of holes 26 and 27 to the posterior sides of small pouch components 25. This aligning material serves likewise to maintain the continuing integrity of holes 26 and 27. FIG. 9 serves to illustrate how a small pouch component 25 is held to lower portion 2 by each of a pair of male coupler units 6 the stiffly swivable heads of which have each been turned through an angle of 90°. FIG. 11 illustrates, in exploded fashion the manner in which a small pouch component 25 can be affixed to one of a plurality of identical large pouch components 15 of the instant invention which can in turn be affixed to a belt coupler holder unit 11 in the manner shown in FIG. 12. Metallically lined first and second large pouch through holes 16 and 17 located respectively in a first upper top posterior side corner and a second upper top posterior side corner of a large pouch component 15 receive each one of a pair of male belt coupler units 12 with stiffly swivelable heads and holes 26 and 27 of a small pouch component 25 receive respectively a first large pouch male coupler unit 23 with a stiffly swivelable head and a second large pouch male coupler unit 24 with a stiffly swivelable head both of which are respectively affixed to a first front upper large pouch corner and a second front upper large pouch corner a of large component 15. The affixation shown in FIG. 12 is the result of turning the stiffly swivelable heads of coupler units 12 and 23 and 24 all through an angle of 90°. The metallic or hard plastic or rubberlike material aligning holes 16 and 17 serves to maintain the continuing integrity of holes 16 and 17. Large pouch components 15 are likewise typically made up of a heavy, sturdy woven cloth or canvas or leather material and it is this material to which the material aligning holes 16 and 17 is affixed. FIG. 13 is an isolated perspective view of one of large pouch components 15. Laterally affixed thereto, as shown, is an exterior side pocket 21 and exterior small tool holding strapping 22. An identical exterior side pocket 21 A and exterior small tool holding strapping 22A is found on the other lateral side of large pouch component 15 though not specifically shown in FIG. 13. Small pouch components 25 hold small carpentry fasteners, one species of each per individual small pouch component 25 whether it be held to upper portion 3 or lower portion 2 of liner component 1 or to a coupler holder unit 11 of belt component 10 or to a large pouch component 15. Large pouch components 15 hold larger carpentry fasteners, up to two species of each per individual large pouch component 15 as well as being able to hold a small pouch component 25 along with perhaps a screwdriver and/or an awl via strapping 22 and 22A together with, for example, a measuring stick in a pocket 21 or 21 A whether held to upper portion 3 or lower portion 2 of liner component 1 or to a coupler holder unit 11 on belt component 10. FIG. 2 serves to illustrate how a loaded large pouch component 15 is held via a coupler holder unit 11 to a belt component 10 worn by a tradesperson B after belt component 10 is detached from liner component 1. Large pouch components 15 can carry up to two species of fasteners or one species of fasteners and a tool within the interior of large pouch component 15 by virtue of the presence of an inside pocket 18 thereof as shown in FIG. 14. Female fastener means 19A on one end of female fastener strap 19, the other end of which is affixed to the upper posterior side of large component 15 between holes 16 and 17 thereof, is affixable to male snap fastener means 20 affixed on a front side of pocket 18 to; when desired, close pocket 18 in order to more adequately secure the contents of pocket 18. FIG. 16 is an isolated perspective view of one of a plurality of identical tool holding components 28 of the instant invention. A tool holding component 28 is threadably held to a belt coupler holding unit 11 in the manner shown in FIG. 15. Also, FIG. 15 illustrates how a component 28 can, once detachably affixed to a belt coupler holding unit 11 in turn detachably affixed to belt component 10, itself hold a hammer C. A pair of metallically lined through holes 29 and 30 respectively are found one each in each of the two respective upper corners of component 28. Affixed at one end thereof to a top edge of component 28 so as to lie vertically is a female snap fastener strap 3 1. Affixed to a second end thereof is a female snap fastener means 32. Affixed at both ends thereof to a front face of component 28 so as to lie horizontally is a male fastener strap 33 centrally affixed to which is a male snap fastener means. Placement of a hammer C into strap 33 followed by snap connecting the male snap fastener means of strap 33 with female snap fastener means 32 enables the hammer to be held fast to tool holding component 28 held in turn to a holding unit 11 by way of turning through an angle of 90° the stiffly swivelable heads of the pair of male belt couplers 12 affixed themselves to holding unit 11 after first inserting couplers 12 one each through holes 29 and 30. The metallic or perhaps hard plastic or rubberlike material, aligning the perimeters of holes 29 and 30 serving to continually maintain the integrity of holes 29 and 30, is affixed to a front face of tool holding component 28.

Respectfully submitted, the instant invention, by virtue of the manner in which all of its abovedescribed component parts are so readily detachably affixed to one another as described above, is indeed veritably revolutionary in the art of building and construction trade tool and fastener carrying devices. The undoubtedly new, ready manner in which the unquestionably unique instant invention facilitates efficient storage and portability of tools and fasteners makes for an extremely useful device in terms of conservation of time and effort expended by a tradesperson working at a building and construction site.

What is claimed is:

1. A tool and fastener holder with detachable holding belt, comprising:

a. a liner component made of sturdy material;

b. a lower portion of said liner component;

c. an upper portion of said liner component;

d. a liner belt attached to a bottom section of said upper portion and a top section of said lower portion;

e. first buckle means affixed to end segments of said liner belt;

f. a plurality of male liner coupler units with swivelable heads affixed to said lower portion of said liner component;

g. a plurality of male liner coupler units with swivelable heads affixed to said upper portion of said liner component;

h. a first pair of oppositionally aligned bucket handle hole arcs cut into said liner component near said top section of said lower portion and near a vertical central axis of symmetry thereof, perimeters of which said hole arcs are lined with solid material affixed to said liner component along the curvatures of said hole arcs;

i. a second pair of oppositionally aligned bucket handle hole arcs cut into said liner component near said top section of said lower portion, each of said second pair being located in said lower portion equidistant from said central axis of symmetry, perimeters of which are lined with solid material affixed to said liner component along the curvatures of said hole arcs;

j. a first plurality of female snap fasteners affixed to an exterior side of said lower portion of said liner component;

k. each of said first plurality of female snap fasteners being aligned with one another and aligned as well with a first one of said first pair of bucket handle hole arcs;

l. a first plurality of male snap fasteners affixed to said exterior side of said lower portion of said liner component;

m. each of said first plurality of male snap fasteners being aligned with one another and aligned as well with a second one of said first pair of bucket handle hole arcs;

n. a second plurality of female snap fasteners affixed to said exterior side of said lower portion of said liner component;

o. each of said second plurality of female snap fasteners being aligned with one another and aligned as well with a first one of said second pair of bucket handle hole arcs;

p. a second plurality of male snap fasteners affixed to said exterior side of said lower portion of said liner component;

q. each of said second plurality of male snap fasteners being aligned with one another and aligned as well with a second one of said second pair of bucket handle hole arcs;

r. said lower portion of said liner component being severable along a line coterminus with said alignment of said first plurality of female snap fasteners and said alignment of said first plurality of male snap fasteners;

s. a belt component made of sturdy material;

t. a plurality of belt holder units made of sturdy material affixable to said belt component;

u. a pair of male belt coupler units with swivelable heads affixed to each of said belt holder units;

v. second buckle means affixed to end segments of said belt component;

w. a belt hole in a body of said belt component, a perimeter of which said belt hole is circumscribed by solid material affixed to said belt component;

x. a plurality of identical large pouch components each made of sturdy material;

y. a first large pouch hole near a first top corner of a posterior side of each of said plurality of large pouch components;

z. each perimeter of each of said first large pouch holes being circumscribed by solid material affixed to said each of said plurality of large pouch components;

aa. a second large pouch hole near a second top corner of said posterior side of said each of said plurality of large pouch components;

bb. each perimeter of each of said second large pouch holes being circumscribed by solid material affixed to said each of said plurality of large pouch components;

cc. an inside pocket piece made of sturdy, heavy cloth material and affixed to said posterior side of said each of said plurality of large pouch components;

dd. a large pouch female snap fastener affixed to a first end of a large pouch female snap fastener strap;

ee. said large pouch female snap fastener strap affixed at a second end thereof to a top edge of an inner surface of said posterior side of said each of said plurality of large pouch components;

ff. a large pouch male snap fastener affixed to an outer side of each said inside pocket piece;

gg. a first exterior pocket piece made of sturdy, heavy cloth material and affixed to an exterior first lateral side of said each of said plurality of large pouch components;

hh. a first piece of sturdy strapping affixed at each of two ends thereof to said exterior first lateral side of said each of said plurality of large pouch components;

ii. a second exterior pocket piece made of a sturdy material and affixed to an exterior second lateral side of said each of said plurality of large pouch components;

jj. a second piece of sturdy strapping affixed at each of two ends thereof to said exterior second lateral side of said each of said plurality of large pouch components;

kk. a first large pouch male coupler unit with swivelable head affixed near a first top corner of an exterior frontal portion of each of said each of said plurality of large pouch components;

ll. a second large pouch male coupler unit with swivelable head affixed near a second top corner of an exterior frontal portion of each of said each of said plurality of large pouch components, and;

mm. said liner component, said belt component, said plurality of belt holder units, and said plurality of large pouch components being joinable to one another by way of said plurality of belt holder units being selectively affixable to said belt component, one of said male coupler units affixed to said liner component being selectively inserted through said belt hole in said belt component, and said male coupler units of said liner component and said belt holder units being selectively inserted through said holes in said large pouch components wherein said swivable heads of each of said male coupler units are each turned through an angle of 90° when inserted through said holes.

2. The tool and fastener holder with detachable holding belt of claim 1, whereby each of said plurality of belt holder units is threadably affixed to said belt component.

3. The tool and fastener holder with detachable holding belt of claim 1, whereby, in lieu of said first plurality of male and female snap fasteners, vertically affixed hook and fastener tape serves to align and detachably hold said lower portion together along said vertical central axis of symmetry thereof and at edges of said lower portion equidistant from said vertical central axis of symmetry.

4. A tool and fastener holder with detachable holding belt, comprising:

a. a liner component made of sturdy material;

b. a lower portion of said liner component;

c. an upper portion of said liner component;

d. a liner belt attached to a bottom section of said upper portion and a top section of said lower portion;

e. first buckle means affixed to end segments of said liner belt;

f. a plurality of male liner coupler units with swivelable heads affixed to said lower portion of said liner component;

g. a plurality of male liner coupler units with swivelable heads affixed to said upper portion of said liner component;

h. a first pair of oppositionally aligned bucket handle hole arcs cut into said liner component near said top section of said lower portion and near a vertical central axis of symmetry thereof, perimeters of which said hole arcs are lined with solid material affixed to said liner component along the curvatures of said hole arcs;

i. a second pair of oppositionally aligned bucket handle hole arcs cut into said liner component near said top section of said lower portion, each of said second pair being located in said lower portion equidistant from said central axis of symmetry, perimeters of which are lined with solid material affixed to said liner component along the curvatures of said hole arcs;

j. a first plurality of female snap fasteners affixed to an exterior side of said lower portion of said liner component;

k. each of said first plurality of female snap fasteners being aligned with one another and aligned as well with a first one of said first pair of bucket handle hole arcs;

l. a first plurality of male snap fasteners affixed to said exterior side of said lower portion of said liner component;

m. each of said first plurality of male snap fasteners being aligned with one another and aligned as well with a second one of said first pair of bucket handle hole arcs;

n. a second plurality of female snap fasteners affixed to said exterior side of said lower portion of said liner component;

o. each of said second plurality of female snap fasteners being aligned with one another and aligned as well with a first one of said second pair of bucket handle hole arcs;

p. a second plurality of male snap fasteners affixed to said exterior side of said lower portion of said liner component;

q. each of said second plurality of male snap fasteners being aligned with one another and aligned as well with a second one of said second pair of bucket handle hole arcs;

r. said lower portion of said liner component being severable along a line coterminus with said alignment of said first plurality of female snap fasteners and said alignment of said first plurality of male snap fasteners;

s. a belt component made of sturdy material;

t. a plurality of belt holder units made of sturdy material affixable to said belt component;

u. a pair of male belt coupler units with swivelable heads affixed to each of said belt holder units;

v. second buckle means affixed to end segments of said belt component;

w. a belt hole in a body of said belt component, a perimeter of which said belt hole is circumscribed by solid material affixed to said belt component;

x. a plurality of identical large pouch components each made of sturdy material;

y. a first large pouch hole near a first top corner of a posterior side of each of said plurality of large pouch components;

z. each perimeter of each of said first large pouch holes being circumscribed by solid material affixed to said each of said plurality of large pouch components;

aa. a second large pouch hole near a second top corner of said posterior side of said each of said plurality of large pouch components;

bb. each perimeter of each of said second large pouch holes being circumscribed by solid material affixed to said each of said plurality of large pouch components;

cc. an inside pocket piece made of sturdy, heavy cloth material and affixed to said posterior side of said each of said plurality of large pouch components;

dd. a large pouch female snap fastener affixed to a first end of a large pouch female snap fastener strap;

ee. said large pouch female snap fastener strap affixed at a second end thereof to a top edge of an inner surface of said posterior side of said each of said plurality of large pouch components;

ff. a large pouch male snap fastener affixed to an outer side of each said inside pocket piece;

gg. a first exterior pocket piece made of sturdy, heavy cloth material and affixed to an exterior first lateral side of said each of said plurality of large pouch components;

hh. a first piece of sturdy strapping affixed at each of two ends thereof to said exterior first lateral side of said each of said plurality of large pouch components;

ii. a second exterior pocket piece made of a sturdy material and affixed to an exterior second lateral side of said each of said plurality of large pouch components;

jj. a second piece of sturdy strapping affixed at each of two ends thereof to said exterior second lateral side of said each of said plurality of large pouch components;

kk. a first large pouch male coupler unit with swivelable head affixed near a first top corner of an exterior frontal portion of each of said each of said plurality of large pouch components;

ll. a second large pouch male coupler unit with swivelable head affixed near a second top corner of an exterior frontal portion of each of said each of said plurality of large pouch components;

mm. a plurality of identical small pouch components each made of sturdy heavy cloth material;

nn. a first small pouch hole near a first top corner in a posterior side of each of said plurality of small pouch components;

oo. a second small pouch hole near a second top corner in said posterior side of said each of said plurality of small pouch components;

pp. each perimeter of each of said first small pouch holes being circumscribed by solid material affixed to said each of said plurality of small pouch components;

qq. each perimeter of each of said second small pouch holes being circumscribed by solid material affixed to said each of said plurality of small pouch components, and;

rr. said liner component, said belt component, said plurality of belt holder units, said plurality of large pouch components, and said plurality of small pouch components being joinable to one another by way of said plurality of belt holder units being selectively affixable to said belt component, one of said male coupler units affixed to said liner component being selectively inserted through said belt hole in said belt component, said male coupler units of said liner component and said belt holder units being selectively inserted through said holes in said large pouch components and said small pouch components, and said male coupler units of said large pouch components being selectively inserted through said holes in said small pouch components wherein said swivable heads of each of said male coupler units are each turned through an angle of 90° when inserted through said holes.

5. The tool and fastener holder with detachable holding belt of claim 4, whereby each of said plurality of belt holder units is threadably affixed to said belt component.

6. The tool and fastener holder with detachable holding belt of claim 4, whereby, in lieu of said first plurality of male and female snap fasteners, vertically affixed hook and fastener tape serves to align and detachably hold said lower portion together along said vertical central axis of symmetry thereof and at edges of said lower portion equidistant from said vertical central axis of symmetry.

7. A tool and fastener holder with detachable holding belt, comprising:

a. a liner component made of sturdy material;

b. a lower portion of said liner component;

c. an upper portion of said liner component;

d. a liner belt attached to a bottom section of said upper portion and a top section of said lower portion;

e. first buckle means affixed to end segments of said liner belt;

f. a plurality of male liner coupler units with swivelable heads affixed to said lower portion of said liner component;

g. a plurality of male liner coupler units with swivelable heads affixed to said upper portion of said liner component;

h. a first pair of oppositionally aligned bucket handle hole arcs cut into said liner component near said top section of said lower portion and near a vertical central axis of symmetry thereof, perimeters of which said hole arcs are lined with solid material affixed to said liner component along the curvatures of said hole arcs;

i. a second pair of oppositionally aligned bucket handle hole arcs cut into said liner component near said top section of said lower portion, each of said second pair being located in said lower portion equidistant from said central axis of symmetry, perimeters of which are lined with solid material affixed to said liner component along the curvatures of said hole arcs;

j. a first plurality of female snap fasteners affixed to an exterior side of said lower portion of said liner component;

k. each of said first plurality of female snap fasteners being aligned with one another and aligned as well with a first one of said first pair of bucket handle hole arcs;

l. a first plurality of male snap fasteners affixed to said exterior side of said lower portion of said liner component;

m. each of said first plurality of male snap fasteners being aligned with one another and aligned as well with a second one of said first pair of bucket handle hole arcs;

n. a second plurality of female snap fasteners affixed to said exterior side of said lower portion of said liner component;

o. each of said second plurality of female snap fasteners being aligned with one another and aligned as well with a first one of said second pair of bucket handle hole arcs;

p. a second plurality of male snap fasteners affixed to said exterior side of said lower portion of said liner component;

q. each of said second plurality of male snap fasteners being aligned with one another and aligned as well with a second one of said second pair of bucket handle hole arcs;

r. said lower portion of said liner component being severable along a line coterminus with said alignment of said first plurality of female snap fasteners and said alignment of said first plurality of male snap fasteners;

s. a belt component made of sturdy material;

t. a plurality of belt holder units made of sturdy material affixable to said belt component;

u. a pair of male belt coupler units with swivelable heads affixed to each of said belt holder units;

v. second buckle means affixed to end segments of said belt component;

w. a belt hole in a body of said belt component, a perimeter of which said belt hole is circumscribed by solid material affixed to said belt component;

x. a plurality of identical large pouch components each made of sturdy material;

y. a first large pouch hole near a first top corner of a posterior side of each of said plurality of large pouch components;

z. each perimeter of each of said first large pouch holes being circumscribed by solid material affixed to said each of said plurality of large pouch components;

aa. a second large pouch hole near a second top corner of said posterior side of said each of said plurality of large pouch components;

bb. each perimeter of each of said second large pouch holes being circumscribed by solid material affixed to said each of said plurality of large pouch components;

cc. an inside pocket piece made of sturdy, heavy cloth material and affixed to said posterior side of said each of said plurality of large pouch components;

dd. a large pouch female snap fastener affixed to a first end of a large pouch female snap fastener strap;

ee. said large pouch female snap fastener strap affixed at a second end thereof to a top edge of an inner surface of said posterior side of said each of said plurality of large pouch components;

ff. a large pouch male snap fastener affixed to an outer side of each said inside pocket piece;

gg. a first exterior pocket piece made of sturdy, heavy cloth material and affixed to an exterior first lateral side of said each of said plurality of large pouch components;

hh. a first piece of sturdy strapping affixed at each of two ends thereof to said exterior first lateral side of said each of said plurality of large pouch components;

ii. a second exterior pocket piece made of a sturdy material and affixed to an exterior second lateral side of said each of said plurality of large pouch components;

jj. a second piece of sturdy strapping affixed at each of two ends thereof to said exterior second lateral side of said each of said plurality of large pouch components;

kk. a first large pouch male coupler unit with swivelable head affixed near a first top corner of an exterior frontal portion of each of said each of said plurality of large pouch components;

ll. a second large pouch male coupler unit with swivelable head affixed near a second top corner of an exterior frontal portion of each of said each of said plurality of large pouch components;

mm. a plurality of identical small pouch components each made of sturdy heavy cloth material;

nn. a first small pouch hole near a first top corner in a posterior side of each of said plurality of small pouch components;

oo. a second small pouch hole near a second top corner in said posterior side of said each of said plurality of small pouch components;

pp. each perimeter of each of said first small pouch holes being circumscribed by solid material affixed to said each of said plurality of small pouch components, and;

qq. each perimeter of each of said second small pouch holes being circumscribed by solid material affixed to said each of said plurality of small pouch components;

rr. a plurality of hardbacked tool holding components;

ss. a first tool holding component coupler hole near a first top corner of each of said plurality of hardbacked tool holding components;

tt. a second tool holding component coupler hole near a second top corner of each of said plurality of hardbacked tool holding components;

uu. perimeters of all of said tool holding component coupler holes being circumscribed by solid material affixed to each one of said plurality of hardbacked tool holding components;

vv. a tool holding component female snap fastener strap affixed at a first end thereof to said each one of said plurality of hardbacked tool holding components between each said first tool holding coupler hole and each said second tool holding coupler hole;

ww. a tool holding female snap fastener affixed at a second end of each of said tool holding component female snap fastener straps;

xx. a tool holding male snap fastener strap with centrally positioned male snap fastener and affixed at both ends thereof to said each one of said plurality of hardbacked tool holding components being readily amenable to receipt by said tool holding female snap fastener;

yy. said liner component, said belt component, said plurality of belt holder units, said plurality of large pouch components, said plurality of small pouch components, and said plurality of tool holding components being joinable to one another by way of said plurality of belt holder units being selectively affixable to said belt component, one of said male coupler units affixed to said liner component being selectively inserted through said belt hole in said belt component, said male coupler units of said liner component and said belt holder units being selectively inserted through said holes in said large pouch components, said small pouch components, and said tool holding components, and said male coupler units of said large pouch components being selectively inserted through said holes in said small pouch components and said tool holding components wherein said swivable heads of each of said male coupler units are each turned through an angle of 90° when inserted through said holes.

8. The tool and fastener holder with detachable holding belt of claim 7 whereby each of said plurality of belt holder units is threadably affixed to said belt component.

9. The tool and fastener holder with detachable holding belt of claim 7, whereby, in lieu of said first plurality of male and female snap fasteners, vertically affixed hook and fastener tape serves to align and detachably hold said lower portion together along said vertical central axis of symmetry thereof and at edges of said lower portion equidistant from said vertical central axis of symmetry.

10. A tool and fastener holder with detachable holding belt, comprising:

a. a liner component made of sturdy material;

b. a lower portion of said liner component;

c. an upper portion of said liner component;

d. a liner belt attached to a bottom section of said upper portion and a top section of said lower portion;

e. first buckle means affixed to end segments of said liner belt;

f. a plurality of male liner coupler units with swivelable heads affixed to said lower portion of said liner component;

g. a plurality of male liner coupler units with swivelable heads affixed to said upper portion of said liner component;

h. a first pair of oppositionally aligned bucket handle hole arcs cut into said liner component near said top section of said lower portion and near a vertical central axis of symmetry thereof, perimeters of which said hole arcs are lined with solid material affixed to said liner component along the curvatures of said hole arcs;

i. a second pair of oppositionally aligned bucket handle hole arcs cut into said liner component near said top section of said lower portion, each of said second pair being located in said lower portion equidistant from said central axis of symmetry, perimeters of which are lined with solid material affixed to said liner component along the curvatures of said hole arcs;

j. a first plurality of female snap fasteners affixed to an exterior side of said lower portion of said liner component;

k. each of said first plurality of female snap fasteners being aligned with one another and aligned as well with a first one of said first pair of bucket handle hole arcs;

l. a first plurality of male snap fasteners affixed to said exterior side of said lower portion of said liner component;

m. each of said first plurality of male snap fasteners being aligned with one another and aligned as well with a second one of said first pair of bucket handle hole arcs;

n. a second plurality of female snap fasteners affixed to said exterior side of said lower portion of said liner component;

o. each of said second plurality of female snap fasteners being aligned with one another and aligned as well with a first one of said second pair of bucket handle hole arcs;

p. a second plurality of male snap fasteners affixed to said exterior side of said lower portion of said liner component;

q. each of said second plurality of male snap fasteners being aligned with one another and aligned as well with a second one of said second pair of bucket handle hole arcs;

r. said lower portion of said liner component being severable along a line coterminus with said alignment of said first plurality of female snap fasteners and said alignment of said first plurality of male snap fasteners;

s. a belt component made of sturdy material;

t. a plurality of belt holder units made of sturdy material affixable to said belt component;

u. a pair of male belt coupler units with swivelable heads affixed to each of said belt holder units;

v. second buckle means affixed to end segments of said belt component;

w. a belt hole in a body of said belt component, a perimeter of which said belt hole is circumscribed by solid material affixed to said belt component;

x. a plurality of identical large pouch components each made of sturdy material;

y. a first large pouch hole near a first top corner of a posterior side of each of said plurality of large pouch components;

z. each perimeter of each of said first large pouch holes being circumscribed by solid material affixed to said each of said plurality of large pouch components;

aa. a second large pouch hole near a second top corner of said posterior side of said each of said plurality of large pouch components;

bb. each perimeter of each of said second large pouch holes being circumscribed by solid material affixed to said each of said plurality of large pouch components;

cc. an inside pocket piece made of sturdy, heavy cloth material and affixed to said posterior side of said each of said plurality of large pouch components;

dd. a large pouch female snap fastener affixed to a first end of a large pouch female snap fastener strap;

ee. said large pouch female snap fastener strap affixed at a second end thereof to a top edge of an inner surface of said posterior side of said each of said plurality of large pouch components;

ff. a large pouch male snap fastener affixed to an outer side of each said inside pocket piece;

gg. a first exterior pocket piece made of sturdy, heavy cloth material and affixed to an exterior first lateral side of said each of said plurality of large pouch components;

hh. a first piece of sturdy strapping affixed at each of two ends thereof to said exterior first lateral side of said each of said plurality of large pouch components;

ii. a second exterior pocket piece made of a sturdy material and affixed to an exterior second lateral side of said each of said plurality of large pouch components;

jj. a second piece of sturdy strapping affixed at each of two ends thereof to said exterior second lateral side of said each of said plurality of large pouch components;

kk. a first large pouch male coupler unit with swivelable head affixed near a first top corner of an exterior frontal portion of each of said each of said plurality of large pouch components;

ll. a second large pouch male coupler unit with swivelable head affixed near a second top corner of an exterior frontal portion of each of said each of said plurality of large pouch components, and;

mm. a pair of identical hanging through holes with one of said hanging through holes located in a first upper corner of said upper portion of said liner component and a second one of said hanging through holes located in a second upper corner of said upper portion of said liner component, and;

nn. each perimeter of each one of said pair of identical hanging through holes being circumscribed by solid material affixed to said upper portion of said liner component, and;

oo. said liner component, said belt component, said plurality of belt holder units, and said plurality of large pouch components being joinable to one another by way of said plurality of belt holder units being selectively affixable to said belt component, one of said male coupler units affixed to said liner component being selectively inserted through said belt hole in said belt component, and said male coupler units of said liner component and said belt holder units being selectively inserted through said holes in said large pouch components wherein said swivable heads of each of said male coupler units are each turned through an angle of 90° when inserted through said holes.

11. The tool and fastener holder with detachable holding belt of claim 10, whereby each of said plurality of belt holder units is threadably affixed to said belt component.

12. The tool and fastener holder with detachable holding belt of claim 10, whereby, in lieu of said first plurality of male and female snap fasteners, vertically affixed hook and fastener tape serves to align and detachably hold said lower portion together along said vertical central axis of symmetry thereof and at edges of said lower portion equidistant from said vertical central axis of symmetry.

13. A tool and fastener holder with detachable holding belt, comprising:

a. liner component made of sturdy material;

b. a lower portion of said liner component;

c. an upper portion of said liner component;

d. a liner belt attached to a bottom section of said upper portion and a top section of said lower portion;

e. first buckle means affixed to end segments of said liner belt;

f. a plurality of male liner coupler units with swivelable heads affixed to said lower portion of said liner component;

g. a plurality of male liner coupler units with swivelable heads affixed to said upper portion of said liner component;

h. a first pair of oppositionally aligned bucket handle hole arcs cut into said liner component near said top section of said lower portion and near a vertical central axis of symmetry thereof, perimeters of which said hole arcs are lined with solid material affixed to said liner component along the curvatures of said hole arcs;

i. a second pair of oppositionally aligned bucket handle hole arcs cut into said liner component near said top section of said lower portion, each of said second pair being located in said lower portion equidistant from said central axis of symmetry, perimeters of which are lined with solid material affixed to said liner component along the curvatures of said hole arcs;

j. a first plurality of female snap fasteners affixed to an exterior side of said lower portion of said liner component;

k. each of said first plurality of female snap fasteners being aligned with one another and aligned as well with a first one of said first pair of bucket handle hole arcs;

l. a first plurality of male snap fasteners affixed to said exterior side of said lower portion of said liner component;

m. each of said first plurality of male snap fasteners being aligned with one another and aligned as well with a second one of said first pair of bucket handle hole arcs;

n. a second plurality of female snap fasteners affixed to said exterior side of said lower portion of said liner component;

o. each of said second plurality of female snap fasteners being aligned with one another and aligned as well with a first one of said second pair of bucket handle hole arcs;

p. a second plurality of male snap fasteners affixed to said exterior side of said lower portion of said liner component;

q. each of said second plurality of male snap fasteners being aligned with one another and aligned as well with a second one of said second pair of bucket handle hole arcs;

r. said lower portion of said liner component being severable along a line coterminus with said alignment of said first plurality of female snap fasteners and said alignment of said first plurality of male snap fasteners;

s. a belt component made of sturdy material;

t. a plurality of belt holder units made of sturdy material affixable to said belt component;

u. a pair of male belt coupler units with swivelable heads affixed to each of said belt holder units;

v. second buckle means affixed to end segments of said belt component;

w. a belt hole in a body of said belt component, a perimeter of which said belt hole is circumscribed by solid material affixed to said belt component;

x. a plurality of identical large pouch components each made of sturdy material;

y. a first large pouch hole near a first top corner of a posterior side of each of said plurality of large pouch components;

z. each perimeter of each of said first large pouch holes being circumscribed by solid material affixed to said each of said plurality of large pouch components;

aa. a second large pouch hole near a second top corner of said posterior side of said each of said plurality of large pouch components;

bb. each perimeter of each of said second large pouch holes being circumscribed by solid material affixed to said each of said plurality of large pouch components;

cc. an inside pocket piece made of sturdy, heavy cloth material and affixed to said posterior side of said each of said plurality of large pouch components;

dd. a large pouch female snap fastener affixed to a first end of a large pouch female snap fastener strap;

ee. said large pouch female snap fastener strap affixed at a second end thereof to a top edge of an inner surface of said posterior side of said each of said plurality of large pouch components;

ff. a large pouch male snap fastener affixed to an outer side of each said inside pocket piece;

gg. a first exterior pocket piece made of sturdy, heavy cloth material and affixed to an exterior first lateral side of said each of said plurality of large pouch components;

hh. a first piece of sturdy strapping affixed at each of two ends thereof to said exterior first lateral side of said each of said plurality of large pouch components;

ii. a second exterior pocket piece made of a sturdy material and affixed to an exterior second lateral side of said each of said plurality of large pouch components;

jj. a second piece of sturdy strapping affixed at each of two ends thereof to said exterior second lateral side of said each of said plurality of large pouch components;

kk. a first large pouch male coupler unit with swivelable head affixed near a first top corner of an exterior frontal portion of each of said each of said plurality of large pouch components;

ll. a second large pouch male coupler unit with swivelable head affixed near a second top corner of an exterior frontal portion of each of said each of said plurality of large pouch components;

mm. a plurality of identical small pouch components each made of sturdy heavy cloth material;

nn. a first small pouch hole near a first top corner in a posterior side of each of said plurality of small pouch components;

oo. a second small pouch hole near a second top corner in said posterior side of said each of said plurality of small pouch components;

pp. each perimeter of each of said first small pouch holes being circumscribed by solid material affixed to said each of said plurality of small pouch components;

qq. each perimeter of each of said second small pouch holes being circumscribed by solid material affixed to said each of said plurality of small pouch components;

rr. a pair of identical hanging through holes with one of said hanging through holes located in a first upper corner of said upper portion of said liner component and a second one of said hanging through holes located in a second upper corner of said upper portion of said liner component;

ss. each perimeter of each of one of said pair of identical hanging through holes being circumscribed by solid material affixed to said upper portion of said liner component, and;

tt. said liner component, said belt component, said plurality of belt holder units, said plurality of large pouch components, and said plurality of small pouch components being joinable to one another by way of said plurality of belt holder units being selectively affixable to said belt component, one of said male coupler units affixed to said liner component being selectively inserted through said belt hole in said belt component, said male coupler units of said liner component and said belt holder units being selectively inserted through said holes in said large pouch components and said small pouch components, and said male coupler units of said large pouch components being selectively inserted through said holes in said small pouch components wherein said swivable heads of each of said male coupler units are each turned through an angle of 90° when inserted through said holes.

14. The tool and fastener holder with detachable holding belt of claim 13, whereby each of said plurality of belt holder units is threadably affixed to said belt component.

15. The tool and fastener holder with detachable holding belt of claim 13, whereby, in lieu of said first plurality of male and female snap fasteners, vertically affixed hook and fastener tape serves to align and detachably hold said lower portion together along said vertical central axis of symmetry thereof and at edges of said lower portion equidistant from said vertical central axis of symmetry.

16. A tool and fastener holder with detachable holding belt, comprising:

a. a liner component made of sturdy material;

b. a lower portion of said liner component;

c. an upper portion of said liner component;

d. a liner belt attached to a bottom section of said upper portion and a top section of said lower portion;

e. first buckle means affixed to end segments of said liner belt;

f. a plurality of male liner coupler units with swivelable heads affixed to said lower portion of said liner component;

g. a plurality of male liner coupler units with swivelable heads affixed to said upper portion of said liner component;

h. a first pair of oppositionally aligned bucket handle hole arcs cut into said liner component near said top section of said lower portion and near a vertical central axis of symmetry thereof, perimeters of which said hole arcs are lined with solid material affixed to said liner component along the curvatures of said hole arcs;

i. a second pair of oppositionally aligned bucket handle hole arcs cut into said liner component near said top section of said lower portion, each of said second pair being located in said lower portion equidistant from said central axis of symmetry, perimeters of which are lined with solid material affixed to said liner component along the curvatures of said hole arcs;

j. a first plurality of female snap fasteners affixed to an exterior side of said lower portion of said liner component;

k. each of said first plurality of female snap fasteners being aligned with one another and aligned as well with a first one of said first pair of bucket handle hole arcs;

l. a first plurality of male snap fasteners affixed to said exterior side of said lower portion of said liner component;

m. each of said first plurality of male snap fasteners being aligned with one another and aligned as well with a second one of said first pair of bucket handle hole arcs;

n. a second plurality of female snap fasteners affixed to said exterior side of said lower portion of said liner component;

o. each of said second plurality of female snap fasteners being aligned with one another and aligned as well with a first one of said second pair of bucket handle hole arcs;

p. a second plurality of male snap fasteners affixed to said exterior side of said lower portion of said liner component;

q. each of said second plurality of male snap fasteners being aligned with one another and aligned as well with a second one of said second pair of bucket handle hole arcs;

r. said lower portion of said liner component being severable along a line coterminus with said alignment of said first plurality of female snap fasteners and said alignment of said first plurality of male snap fasteners;

s. a belt component made of sturdy material;

t. a plurality of belt holder units made of sturdy material affixable to said belt component;

u. a pair of male belt coupler units with swivelable heads affixed to each of said belt holder units;

v. second buckle means affixed to end segments of said belt component;

w. a belt hole in a body of said belt component, a perimeter of which said belt hole is circumscribed by solid material affixed to said belt component;

x. a plurality of identical large pouch components each made of sturdy material;

y. a first large pouch hole near a first top corner of a posterior side of each of said plurality of large pouch components;

z. each perimeter of each of said first large pouch holes being circumscribed by solid material affixed to said each of said plurality of large pouch components;

aa. a second large pouch hole near a second top corner of said posterior side of said each of said plurality of large pouch components;

bb. each perimeter of each of said second large pouch holes being circumscribed by solid material affixed to said each of said plurality of large pouch components;

cc. an inside pocket piece made of sturdy, heavy cloth material and affixed to said posterior side of said each of said plurality of large pouch components;

dd. a large pouch female snap fastener affixed to a first end of a large pouch female snap fastener strap;

ee. said large pouch female snap fastener strap affixed at a second end thereof to a top edge of an inner surface of said posterior side of said each of said plurality of large pouch components;

ff. a large pouch male snap fastener affixed to an outer side of each said inside pocket piece;

gg. a first exterior pocket piece made of sturdy, heavy cloth material and affixed to an exterior first lateral side of said each of said plurality of large pouch components;

hh. a first piece of sturdy strapping affixed at each of two ends thereof to said exterior first lateral side of said each of said plurality of large pouch components;

ii. a second exterior pocket piece made of a sturdy material and affixed to an exterior second lateral side of said each of said plurality of large pouch components;

jj. a second piece of sturdy strapping affixed at each of two ends thereof to said exterior second lateral side of said each of said plurality of large pouch components;

kk. a first large pouch male coupler unit with swivelable head affixed near a first top corner of an exterior frontal portion of each of said each of said plurality of large pouch components;

ll. a second large pouch male coupler unit with swivelable head affixed near a second top corner of an exterior frontal portion of each of said each of said plurality of large pouch components;

mm. a plurality of identical small pouch components each made of sturdy heavy cloth material;

nn. a first small pouch hole near a first top corner in a posterior side of each of said plurality of small pouch components;

oo. a second small pouch hole near a second top corner in said posterior side of said each of said plurality of small pouch components;

pp. each perimeter of each of said first small pouch holes being circumscribed by solid material affixed to said each of said plurality of small pouch components, and;

qq. each perimeter of each of said second small pouch holes being circumscribed by solid material affixed to said each of said plurality of small pouch components;

rr. a plurality of hardbacked tool holding components;

ss. a first tool holding component coupler hole near a first top corner of each of said plurality of hardbacked tool holding components;

tt. a second tool holding component coupler hole near a second top corner of each of said plurality of hardbacked tool holding components;

uu. perimeters of all of said tool holding component coupler holes being circumscribed by solid material affixed to each one of said plurality of hardbacked tool holding components;

vv. a tool holding component female snap fastener strap affixed at a first end thereof to said each one of said plurality of hardbacked tool holding components between each said first tool holding coupler hole and each said second tool holding coupler hole;

ww. a tool holding female snap fastener affixed at a second end of each of said tool holding component female snap fastener straps;

xx. a tool holding male snap fastener strap with centrally positioned male snap fastener and affixed at both ends thereof to said each one of said plurality of hardbacked tool holding components being readily amenable to receipt by said tool holding female snap fastener;

yy. a pair of identical hanging through holes with, one of said hanging through holes located in a first upper corner of said upper portion of said liner component and a second one of said hanging through holes located in a second upper corner of said upper portion of said liner component;

zz. each perimeter of each one of said pair of identical hanging through holes being circumscribed by solid material affixed to said upper portion of said liner component, and;

aaa. said liner component, said belt component, said plurality of belt holder units, said plurality of large pouch components, said plurality of small pouch components, and said plurality of tool holding components being joinable to one another by way of said plurality of belt holder units being selectively affixable to said belt component, one of said male coupler units affixed to said liner component being selectively inserted through said belt hole in said belt component, said male coupler units of said liner component and said belt holder units being selectively inserted through said holes in said large pouch components, said small pouch components, and said tool holding components, and said male coupler units of said large pouch components being selectively inserted through said holes in said small pouch components and said tool holding components wherein said swivable heads of each of said male coupler units are each turned through an angle of 90° when inserted through said holes.

17. The tool and fastener holder with detachable holding belt of claim 16, whereby each of said plurality of belt holder units is threadably affixed to said belt component.

18. The tool and fastener holder with detachable holding belt of claim 16, whereby, in lieu of said first plurality of male and female snap fasteners, vertically affixed hook and fastener tape serves to align and detachably hold said lower portion together along said vertical central axis of symmetry thereof and at edges of said lower portion equidistant from said vertical central axis of symmetry.

* * * * *